United States Patent [19]

Müller et al.

[11] Patent Number: 4,782,314

[45] Date of Patent: Nov. 1, 1988

[54] FLUID-TIGHT COUPLING DEVICE FOR MICROWAVES

[75] Inventors: Günther Müller, Rudersberg; Rolf Wilhelm, Calw/Stammheim, both of Fed. Rep. of Germany

[73] Assignee: Max-Planck Gesellschaft zur Foerderung der Wissenschaften e.V., Goettingen, Fed. Rep. of Germany

[21] Appl. No.: 54,850

[22] Filed: May 27, 1987

[30] Foreign Application Priority Data

May 27, 1986 [DE] Fed. Rep. of Germany ..... 3617779

[51] Int. Cl.[4] ..... H01P 1/08

[52] U.S. Cl. ..... 333/252; 333/254

[58] Field of Search ..... 333/230, 252, 254

[56] References Cited

U.S. PATENT DOCUMENTS

| | | | |
|---|---|---|---|
| 3,039,068 | 6/1962 | Greco | 333/252 |
| 4,297,662 | 10/1981 | Gross et al. . | |
| 4,593,259 | 6/1986 | Fox et al. | 333/252 X |

FOREIGN PATENT DOCUMENTS

| | | |
|---|---|---|
| B 25712 | 10/1956 | Fed. Rep. of Germany . |
| 2907808 | 9/1980 | Fed. Rep. of Germany . |
| 2907762 | 9/1980 | Fed. Rep. of Germany . |
| 998815 | 7/1965 | United Kingdom . |

*Primary Examiner*—Paul Gensler

*Attorney, Agent, or Firm*—Spencer & Frank

[57] ABSTRACT

A fluid-tight coupling device for microwave radiation of high energy includes a tubular dielectric window which is sealingly connected to one end of a waveguide supplying the microwave radiation and forms a continuation of the waveguide. The other end of the tube forming the window is tightly sealed by an essentially conical reflector. The tube forming the window is surrounded on the outside by a cup-shaped waveguide portion. The reflecting surface of the reflector and the reflecting inner surface of the cup-shaped waveguide portion are formed such that the microwave radiation emerging from the waveguide is reflected through the tubular window into the cup-shaped waveguide portion and from the latter to the open end of the waveguide portion in such a manner that an input mode of type $TE_{mn}$ is transformed into itself or a well-defined adjacent mode $TE_{m'n'}$, further secondary modes are minimized and at the same time return waves are also minimized. Due to the cylidrical form a window area of one or two orders of magnitude larger than in the known plane windows is obtained and thus a correspondingly smaller area stress so that even very high microwave powers can be transmitted.

7 Claims, 2 Drawing Sheets

FLUID-TIGHT COUPLING DEVICE FOR MICROWAVES

BACKGROUND OF THE INVENTION

The present invention relates to waveguides for microwaves, more specifically to a fluid-tight coupling device for microwave radiation of high energy comprising a waveguide having an input end adapted to be coupled to a microwave source and an output end which is sealed fluid-tight with a dielectric window permeable for the microwave radiation.

For coupling microwaves out of a microwave source and for coupling microwaves from a gas-filled waveguide into a vacuum vessel and similar uses, vacuum-tight or more generally fluid-tight coupling means ("microwave windows") are required. For extremely high microwave powers, for example in the megawatt range, at relatively high frequencies (e.g. above a few 10 GHz, e.g. between 60 and 100 GHz, and relatively large pulse lengths (e.g. several seconds up to continuous waves), as can for example be produced with gyrotrons or free-electron lasers, power densities and thermal stresses occur which are difficult to handle with the known single-pane or multipane windows. For special uses, e.g. the high-frequency heating of a plasma in fusion research, windowless operation of the high-frequency source is therefore being considered. Such an operation however involves considerable disadvantages and great problems.

U.S. Pat. No. 4,297,662 discloses a vacuum-tight high-frequency-permeable window arrangement between an input and an output coaxial line in which between the input and the output coaxial line a ceramic hollow cylinder is disposed which surrounds the inner conductor of the input coaxial line in the region of the transition to the output coaxial line as continuation of the outer conductor of the input coaxial line. For adaptation of the input coaxial line to the output coaxial line in the region of the window arrangement adapting elements are provided, for example an annular adapting element which surrounds the ceramic hollow cylinder in spaced relationship and is mounted at the inner side of the inner conductor of the output coaxial line. These adapting elements are not suitable for waveguides not having any inner conductor.

SUMMARY OF THE INVENTION

The present invention solves the problem of providing a fluid-tight coupling means for microwave waveguides which is also suitable for very high high-frequency throughput powers and long-time loads and ensures satisfactory mode transition in that the window has the form of a tube which forms a continuation of the waveguide, is sealingly connected at one end to the output end thereof and at the other end is sealed by a microwave reflector which is conical to the first approximation and which reflects the microwave radiation emerging axially from the output end of the waveguide opposite the reflector laterally through the tubular window and that the window is surrounded by an approximately cup-shaped waveguide portion which reflects the microwave radiation incident on it through the window substantially in the direction in which the microwave radiation emerges from the output end of the waveguide.

The coupling means according to the invention which operates on the principle of reflection rather than impedance matching, enables distribution of the HF power loss occurring of typically 1 to 2% of the HF throughput power by the at least approximately conical reflector relatively uniformly over the window area, which is typically one to two orders of magnitude greater than in the known microwave windows. By the cylindrical form of the actual window a high mechanical strength is also achieved so that even with relatively large cylinder diameters very small wall thicknesses are sufficient, thus reducing the absorption and accordingly the power loss.

With an HF throughput power of 1 to 2 MW a mean area stress of 3 to 4 watt/cm$^2$ can be achieved which can readily be dissipated by a forced air or gas flow.

For still higher throughput powers of the order of magnitude of 10 to 20 MW the window can be cooled from outside with a suitable low-attenuation cooling fluid, for example a suitable oil, in particular silicone oils or petroleum, which can possibly be circulated with free surface (vertical position of the input waveguide).

The coupling means according to the invention is particularly, although not exclusively, suitable for high-frequency sources with axial-symmetrical mode emission $TE_{on}$ (e.g. gyrotrons). With nonaxial-symmetrical modes, for example a whispering gallery where the $TE_{mn}$ mode is one which has large m and low n values, a uniform stressing of the window area can be achieved by rotation, for example by circularly polarized emission.

DESCRIPTION OF PREFERRED EMBODIMENTS

Figure 1:
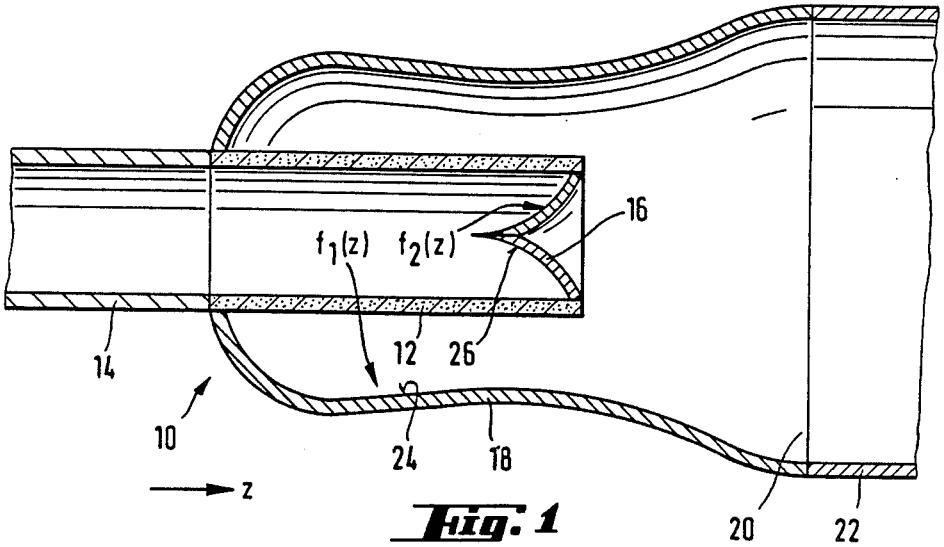
FIGS. 1 to 4 show schematic axial section views of four different embodiments of the coupling device (microwave window arrangement) according to the invention. All the embodiments shown are rotational symmetric.

The microwave window arrangement 10 illustrated in FIG. 1 comprises a cylindrical tube 12 of a dielectric microwave-permeable material as low-loss as possible, for example high-frequency ceramic, $Al_2O_3$, $SiO_2$ or quartz glass. The tube 12 forms an aligning continuation of a waveguide 14 which has a circular cross-section and can form the output waveguide of a microwave source, for example a gyrotron or a free-electron laser. The one end of the dielectric tube 12 is connected vacuum-tight to the end of the waveguide 14. At the other end of the tube 12 a reflector 16 conical to a first approximation is fused-on in vacuum-tight manner and projects into the interior of the tube. At the end of the waveguide 14 connected to the tube 12 a cup-like waveguide portion 18 is further attached at the outside and surrounds the tube 12 in spaced relationship, extending beyond the end thereof and having an open end 20 which is remote from the waveguide 14 and which can for example be connected to a waveguide 22 of enlarged cross-section leading to a consumer of the microwave power, or can act in the manner of a horn radiator.

The waveguide portion 18 consisting of metal has a polished reflecting substantially tulip-shaped inner wall 24 which in the region opposite the tube 12 extends in cross-section according to a function $f_1(z)$, z denoting the axial direction. The inner wall 24 has for example a substantially spherical segment adjoining the hollow tube waveguide 14 followed by a short approximately cylindrical portion and finally a portion which widens along a gradual curve and having an end parallel to the axis. The reflector 16 consisting of metal or ceramic has a reflecting smooth inner surface 26 which tapers to a point in the direction towards the waveguide 14 and extends from the axis outwardly concave corresponding to a second function $f_2(z)$. The functions $f_1(z)$ and $f_2(z)$ are chosen so that the microwave radiation from the waveguide 14 incident with a mode of type $TE_{mn}$ on the surface 26 of the reflector 16, after passage through the tube 12 acting as actual window, is transformed at the surface 24 of the waveguide portion 18 to itself or a well-defined adjacent mode ($TE_{m'n'}$), further secondary modes are minimized and at the same time return waves are also minimized. The window structure according to FIG. 1 is suitable for $TE_{on}$ modes and (possible rotating) $TE_{mn}$ modes with m greater than 0. A first determination of the functions $f_1(z)$ and $f_2(z)$ can be done with the aid of lightoptical reflection tests. For further optimization a variation method may follow, for example using finite elements. The optimization can be carried out and checked with the aid of a suitable mode analyzer (k spectrometer) as regards refelections and interference mode generations.

Figure 2:
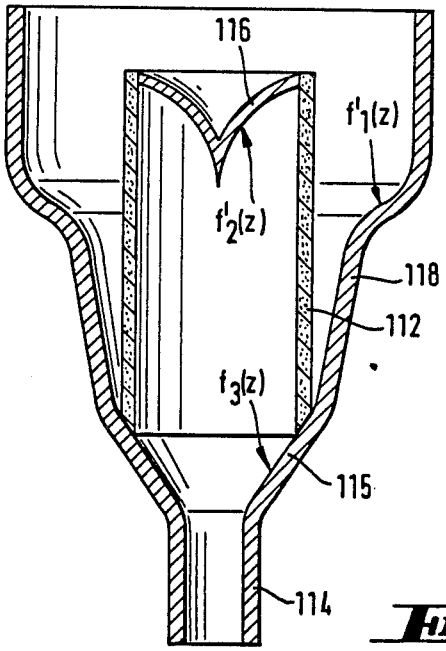

The microwave window arrangement according to FIG. 2 differs from that according to FIG. 1 in particular in that the waveguide 114 leading to the window structure has a widened portion 115 whose diameter gradually increases and whose inner wall runs corresponding to a function $f_3(z)$. The end of the widened portion 115 is sealingly connected to a ceramic tube 112 serving as window and a cup-shaped portion 118 which surrounds the ceramic tube in spaced relationship. The tube 112 thus has here a greater diameter than the original incoming waveguide 114. At the end remote from the waveguide 114 a reflector 116 of the type explained with reference to FIG. 1 is again sealingly attached and the surface thereof is defined by a function $f'_2(z)$.

The function $f'_1(z)$ of the reflecting surface of the cupshaped waveguide portion 118 and the function $f'_2(z)$ of the reflector 116 are chosen in the manner explained with reference to FIG. 1 for the functions $f_1(z)$ and $f_2(z)$. The widening 115 and the resulting possible larger diameter of the tube 112 permit a reduction of the overall length of the microwave window arrangement because a greater window area corresponding to the greater diameter is available per unit length. The function $f_3(z)$ is incorporated into the optimization of the functions $f'_1(z)$ and $f'_2(z)$.

Figure 3:
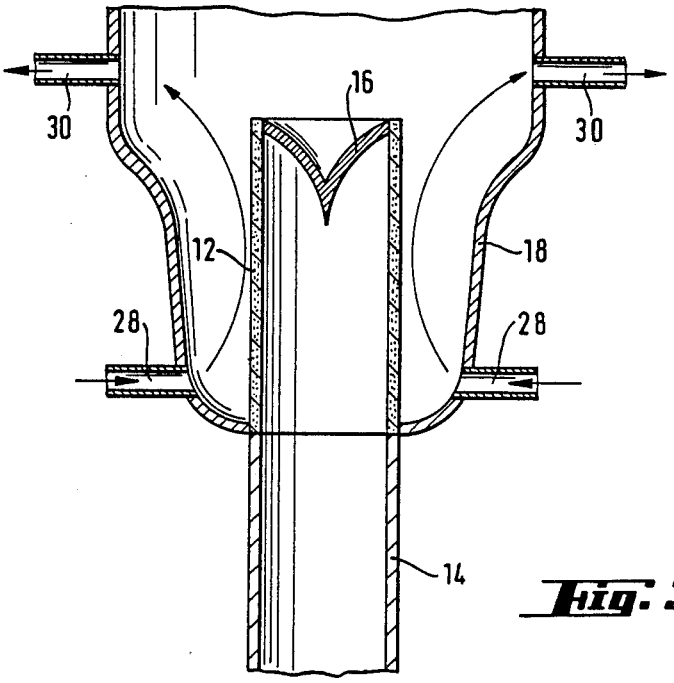

The embodiment of FIG. 3 corresponds substantially to that of FIG. 1 with the exception that the cup-shaped waveguide portion 18 is provided with terminals 28 and 30 for introduction and removal respectively of a gas for cooling the tube 12. This embodiment is suitable for example for throughput powers of 1 to 2 MW.

Figure 4:
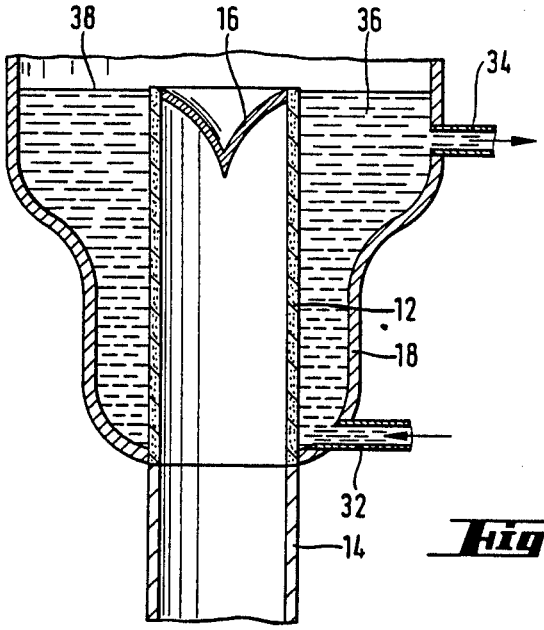

The embodiment according to FIG. 4 is suitable for extremely high throughput powers of for example the order of magnitude of 10 MW and more. The window arrangement is operated with upright axis and the waveguide portion 18 is provided with connections 32, 34 for entry and exit of a dielectric cooling fluid 36 of low attentuation which can form a free liquid surface 38 and is circulated in a cooling circuit not illustrated. Very pure petroleum is for example suitable as cooling fluid.

Typical dimensions for frequencies from about 60 to 100 GHz are:

axial length of the tube 12 about 0.5–1 m;

diameter of the tube 12 about 50–100 mm;

diameter of the outlet end of the waveguide portion 18 about 100–200 mm.

Although the invention has been described by reference to particular embodiments thereof, many changes and modifications may becomes apparent to those skilled in the art without departing from the spirit and scope of the invention.

We claim:

1. A fluid-tight coupling means for microwave radiation of high energy comprising a first waveguide having an input end adapted to be coupled to a microwave source and an output end, a dielectric window in the form of a tube which forms a continuation of said waveguide having a first end sealed in a fluid-tight manner with said output end of said waveguide, a substantially conical microwave reflector sealed to a second end of said dielectric window which reflects the microwave radiation emerging axially from said output end of said waveguide laterally through said dielectric window, and an approximately cup-shaped second waveguide portion surrounding said dielectric window for reflecting said microwave radiation passing through said dielectric window substantially in a direction in which said microwave radiation emerges from said output end of said first waveguide towards an output end of said second waveguide.

2. Coupling means according to claim 1, wherein said reflector has the form of a rotation body having an axial section which tapers from a base portion to a tip portion in the direction towards the output end of said first waveguide and the reflecting surface of which is concave towards said first waveguide in the axial section between said tip portion and said base portion.

3. Coupling means according to claim 1, wherein said waveguide portion surrounding said dielectric window has a substantially tulip-shaped reflecting inner surface.

4. Coupling means according to claim 1, wherein said output end of said first waveguide has a cross-section widening in said direction of said microwave radiation and said dielectric window has a correspondingly large diameter.

5. Coupling means according to claim 1 further comprising means for supplying a cooling fluid to the outside of said dielectric window.

6. Coupling means according to claim 5, wherein said waveguide portion surrounding said dielectric window is provided with an inlet line and an outlet line for a low-loss liquid coolant.

7. Coupling means according to claim 6, wherein said dielectric window and said second waveguide portion surrounding it are disposed with a substantially vertical axis and the cooling fluid forms a free fluid surface in said second waveguide portion.

* * * * *